US006935423B2

(12) United States Patent
Kusmer

(10) Patent No.: US 6,935,423 B2
(45) Date of Patent: Aug. 30, 2005

(54) BOREHOLE RETENTION DEVICE

(75) Inventor: Daniel P. Kusmer, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 588 days.

(21) Appl. No.: 09/845,473

(22) Filed: Apr. 30, 2001

(65) Prior Publication Data

US 2002/0032126 A1 Mar. 14, 2002

Related U.S. Application Data

(60) Provisional application No. 60/201,353, filed on May 2, 2000.

(51) Int. Cl.[7] ..... E21B 23/01

(52) U.S. Cl. ..... 166/217; 166/243; 166/382

(58) Field of Search ..... 166/382, 385, 166/206, 207, 212, 214, 215, 216, 217, 243

(56) References Cited

U.S. PATENT DOCUMENTS 1,147,108 A * 7/1915 McKissick ..... 166/216
2,102,055 A * 12/1937 Walter ..... 166/55.3
2,708,011 A * 5/1955 Reed ..... 166/118

(Continued)

FOREIGN PATENT DOCUMENTS

WO WO 97/08418 3/1997 ..... E21B/4/18
WO WO 98/01651 1/1998 ..... E21B/23/00

OTHER PUBLICATIONS

The Natural Selection Research Group: *Inchworm Mobility—Stable, Reliable and Inexpensive*; A. Ferwom, D. Stacey; (pp. 1–4); Undated.

CSIRO–UTS Electrical Machines: *Oil Well Tractor*; (pp. 1); undated.

Scandinavian Oil–Gas Magazine; *Well Tractor for use in Deviated and Horizontal Wells*; F. Schüssler; (pp. 1–3) Undated.

SPE/ADC Drilling Conference (SPE 37656): *Extending the Reach of Coiled Tubing Drilling* (*Thrusters, Equalizers, and Tractors*); J. Leising, E.C. Onyia, S.C. Townsend, et al. Mar. 4–6, 1997; (pp. 1–14).

SPE Petroleum Conference (SPE 028871); *Well Tractors for Highly Deviated and Horizontal Wells*; J. Hallundaek; Oct. 25–27, 1994; (pp. 57–62).

68$^{th}$ Annual Technical Conference of SPE (SPE 26536); *Development of Composite Coiled Tubing for Oilfield Services*; A. Sas–Jaworsky, J.G. Williams; Oct. 3–6, 1993 (pp. 1–15).

U.S. Appl. No. 09/777,421, entitled *Gripper Assembly for Downhole Tractors* (46 p. with 18 sheets drawings).

*Primary Examiner*—David Bagnell
*Assistant Examiner*—Jennifer H Gay
(74) *Attorney, Agent, or Firm*—Conley Rose, P.C.

(57) ABSTRACT

A borehole retention assembly for anchoring a well tool within a wellbore including a gripping assembly and an actuation assembly. The gripping assembly includes expandable members such that upon expanding the expandable members, the gripping assembly engages the wall of the borehole. The gripping assembly includes a pair of expandable members and a medial member, the members having cooperating tapered surfaces therebetween such that upon the actuation assembly contracting the gripping assembly, the expandable members are cammed outwardly against the borehole wall. The gripping assembly is mounted on a mandrel enabling them to resist rotational and axial forces on the well tool. When engaged, space is provided on each side of the borehole retention assembly such that annular flow is permitted therearound.

11 Claims, 10 Drawing Sheets

U.S. PATENT DOCUMENTS

| | | | | | |
|---|---|---|---|---|---|
| 2,763,327 | A | * | 9/1956 | Ransom | 166/98 |
| 2,878,877 | A | * | 3/1959 | Baker | 166/212 |
| 3,029,874 | A | * | 4/1962 | Turman | 166/212 |
| 3,177,938 | A | * | 4/1965 | Roussin | 166/381 |
| 3,225,843 | A | | 12/1965 | Ortloff et al. | |
| 3,403,731 | A | * | 10/1968 | Arutunoff | 166/211 |
| 3,570,603 | A | * | 3/1971 | Kammerer et al. | 166/290 |
| 3,741,302 | A | * | 6/1973 | Brown | 166/208 |
| 3,799,277 | A | | 3/1974 | Kellner | 175/94 |
| RE28,449 | E | | 6/1975 | Edmond | 175/94 |
| 3,978,930 | A | | 9/1976 | Schroeder | 175/94 |
| 4,060,141 | A | | 11/1977 | Catterfeld | 175/94 |
| 4,415,029 | A | * | 11/1983 | Pratt et al. | 166/212 |
| 4,437,517 | A | * | 3/1984 | Bianchi et al. | 166/120 |
| 4,463,814 | A | | 8/1984 | Horstmeyer et al. | 175/45 |
| 4,496,000 | A | * | 1/1985 | Weeks | 166/382 |
| 4,542,788 | A | * | 9/1985 | Semar | 166/217 |
| 4,957,162 | A | | 9/1990 | Etourmy et al. | 166/212 |
| 4,971,146 | A | | 11/1990 | Terrell | 166/55 |
| 5,060,737 | A | | 10/1991 | Mohn | 175/104 |
| 5,186,264 | A | | 2/1993 | du Chaffaut | 175/27 |
| 5,265,675 | A | | 11/1993 | Hearn et al. | 166/297 |
| 5,287,920 | A | | 2/1994 | Terrell | 166/55 |
| 5,316,094 | A | | 5/1994 | Pringle | 175/74 |
| 5,348,090 | A | * | 9/1994 | Leismer | 166/211 |
| 5,361,833 | A | * | 11/1994 | Schock et al. | 166/117.6 |
| 5,394,951 | A | | 3/1995 | Pringle et al. | 175/61 |
| 5,497,707 | A | | 3/1996 | Box | 104/138.2 |
| 5,601,025 | A | | 2/1997 | Box | 104/138.2 |
| 5,662,020 | A | | 9/1997 | Morita et al. | 91/44 |
| 5,765,640 | A | * | 6/1998 | Milne et al. | 166/206 |
| 5,794,703 | A | | 8/1998 | Newman et al. | 166/381 |
| 5,829,531 | A | * | 11/1998 | Hebert et al. | 166/382 |
| 6,003,606 | A | | 12/1999 | Moore et al. | 166/381 |
| 6,026,899 | A | | 2/2000 | Arizmendi et al. | 166/216 |
| 6,089,323 | A | * | 7/2000 | Newman et al. | 166/381 |
| 6,112,809 | A | * | 9/2000 | Angle | 166/66 |
| 6,629,568 | B2 | * | 10/2003 | Post et al. | 166/382 |

* cited by examiner

BOREHOLE RETENTION DEVICE

CROSS-REFERENCE TO RELATED APPLICATION

The present application claims the benefit of 35 U.S.C. 119 of U.S. provisional application Ser. No. 60/201,353, filed May 2, 2000 and entitled Borehole Retention Device, hereby incorporated herein by reference in its entirety.

BACKGROUND OF THE INVENTION

The present invention relates to anchors or traction modules for thrust loads imparted by well tools, such as a thruster or tractor used in an assembly for performing a downhole operation in a well and more particularly to packer feet on a tractor in a bottom hole assembly, disposed on an umbilical, with a power section for rotating a bit while the tractor moves the bottom hole assembly within the well.

In the course of drilling and completing oil and gas wells, it is sometimes desirable to set an anchor in closed or open hole to serve as a reaction point for various thrust forces imparted by operating tools. Expanding anchors, very much like packers, usually are fluted around the exterior to allow flow to bypass the anchor and up the well annulus. Such externally fluted anchors will sometimes bury themselves in soft formations and completely close off all flow channels causing major well problems.

A thruster or tractor is one well tool which uses anchors as a reaction point. A tractor is part of a bottom hole assembly used on coiled tubing with the bottom hole assembly having a downhole motor providing the power to rotate a bit for drilling the borehole. The bottom hole assembly operates only in the sliding mode since the coiled tubing is not rotated at the surface like that of steel drill pipe which is rotated by a rotary table on the rig. Drilling fluids flow down the umbilical and through the bottom hole assembly and bit to cool the bit and return the cuttings up the annulus around the bottom hole assembly and umbilical to the surface. The bottom hole assembly includes a tractor which propels the bottom hole assembly down the borehole.

One such self-propelled tractor for propelling the bottom hole assembly in the borehole is manufactured by Western Well Tool and is described in U.S. Pat. No. 6,003,606, hereby incorporated herein by reference. The tractor includes an upper and lower housing with a packerfoot mounted on each end. Each housing has a hydraulic cylinder and ram for moving the propulsion system within the borehole. The tractor operates by the lower packerfoot expanding into engagement with the wall of the borehole with the ram in the lower housing extending in the cylinder to force the bit downhole. Simultaneously, the upper packerfoot contracts and moves to the other end of the upper housing. Once the ram in the lower housing completes its stroke, the upper packerfoot expands, then the hydraulic ram in the upper housing is actuated to propel the bit and motor further downhole as the lower packerfoot contracts and resets at the other end of the lower housing. This cycle is repeated to continuously move the bottom hole assembly within the borehole to drill the well. The tractor can propel the bottom hole assembly in either direction in the borehole.

The packerfoot of the Western Well Tool tractor includes an elastomeric body that inflates when filled with fluid. The elastomeric body can be made of a variety of materials such as reinforced graphite or KEVLAR®. The aft end of the packerfoot attaches to a barrel end which surrounds a cylindrical pipe on the tractor. The barrel end is slidable relative to the cylindrical pipe. The forward end is connected to the barrel end. Seals are located between the barrel end and the packerfoot and between the barrel end and the cylindrical pipe to prevent fluid escape. The packer feet include longitudinal projections or ribs circumferentially spaced around the external surface of the packerfeet so as to form flutes therebetween to provide a fluid flow area and return flow path between the ribs for the flow of returns through the annulus around the tractor during drilling. The ribs engage the earth bore which has been drilled. These longitudinal projections or ribs are not effective in soft formations because upon expansion of the packerfeet, the ribs penetrate and bury in the soft earth formation causing the flutes to become packed off with earth and closing the return flow path through the annulus for the cuttings and return fluid. Flow passages must be maintained between the packeffeet and housings to allow the passage of drilling fluids through the tractor to expand the packerfeet and to maintain the drilling. Blockage also causes the packerfeet to be blown off the tractor due to the hydraulic pressure through the annulus.

Another deficiency of prior art packerfeet is that they are made of an elastomeric, stretchable material such that upon expansion, the packerfeet balloon and stretch to engage the borehole wall. Thus when the packerfoot anchors to the borehole wall, all of the axial load and torsional load from the tractor is placed on the stretched material forming the packerfoot. These combined axial tensile loads, expansion stresses and hoop stresses are more than can be handled by a piece of fabric or elastomeric material which cannot endure these stresses. Thus it is an objective to prevent the pressure element from taking any of the torsional or axial loads from the borehole wall.

Another deficiency of the prior art packerfeet is that the amount of radial expansion is small. This is due to the limit that the reinforcing fabric which is embedded in the elastomer can expand to. An means to extend the radial expansion capabilities of packerfeet is highly desirable.

Other packerfeet are limited to expanding the packerfeet the radial distance between the propulsion system mandrel and the wall of the borehole. One design includes one wedge on each side to force a bow spring outwardly into engagement with the borehole wall. The bow springs have small rollers that are connected to the springs by axles passing through small holes in the springs. The wedges are each attached to a piston and cylinder such that when the piston moves and translates axially, the rollers ride up the two wedge surfaces so as to move radially outward and in turn push out the bow springs. Single wedges reduces the camming area for camming the packerfeet into engagement with the borehole wall creating high stresses on the carrring surfaces.

The present invention overcomes the deficiencies of the prior art.

SUMMARY OF THE INVENTION

A borehole retention assembly for anchoring a well tool within a wellbore including a gripping assembly and an actuation assembly. The gripping assembly includes expandable members such that upon expanding the expandable members, the gripping assembly engages the wall of the borehole. The gripping assembly includes a pair of expandable members and a medial member, the members having cooperating tapered surfaces therebetween such that upon the actuation assembly contracting the gripping assembly, the expandable members are cammed outwardly against the borehole wall. The gripping assembly is mounted on a mandrel enabling them to resist rotational and axial forces on the well tool. When engaged, space is provided on each side of the borehole retention assembly such that annular flow is permitted therearound.

In one application, the borehole retention assembly includes an upstream borehole retention assembly mounted on an upstream section of a housing of a propulsion system and a downstream borehole retention assembly mounted on a downstream section of the housing. The borehole retention assemblies are preferably mounted on a propulsion tool to anchor the propulsion tool within the wellbore as the propulsion tool applies axial loads to a drill bit and resists reactive torque from a downhole motor rotating the bit.

The preferred embodiment of the present invention provides a larger expansion ratio and a more effective fluid flow-through area whether in the expanded or contracted position. A further advantage of the present invention is the use of an efficient, reliable and less expensive downhole umbilical propulsion system and survey system for accurate directional drilling.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENTS

Figure 1:
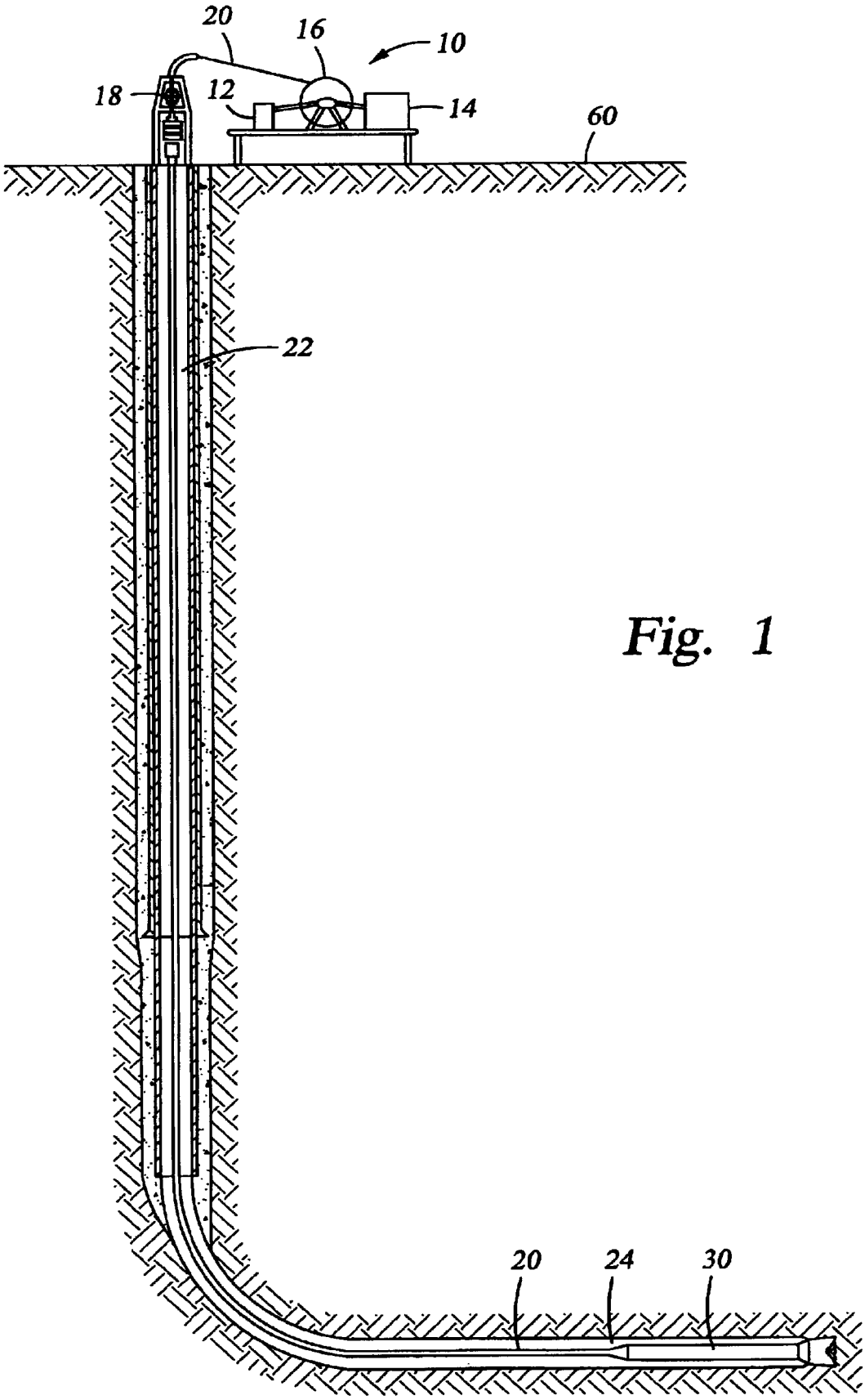
FIG. 1 is a schematic view of an example well with a bottom hole assembly on an umbilical.

The present invention relates to methods and apparatus for anchoring a well tool in a well. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

In particular, various embodiments of the present invention provide a number of different constructions and methods of operation of the traction or retention module, each of which may be used to anchor a well tool in a borehole, casing, or pipe for a well including a new borehole, an extended reach borehole, extending an existing borehole, a sidetracked borehole, a deviated borehole, enlarging a existing borehole, reaming an existing borehole, and other types of boreholes for drilling and completing a production zone. The embodiments of the present invention also provide a plurality of methods for using the traction module of the present invention. It is to be fully recognized that the different teachings of the embodiments discussed below may be employed separately or in any suitable combination to produce desired results. In particular the present system may be used in practically any type of downhole tractor or thruster. Reference to "up", "upstream", "down", or "downstream" are made for purposes of ease of description with "up" or "upstream" meaning away from the bit and "down" or "downstream" meaning toward the bit.

Referring initially to FIG. 1, there is shown a coiled tubing system 10 as an exemplary operating environment for the present invention. Coiled tubing operation system 10 includes a power supply 12, a surface processor 14, and a coiled tubing spool 16. An injector head unit 18 feeds and directs coiled tubing 20 from the spool 16 into the well 22. The coiled tubing 20 is preferably composite coiled tubing. A bottom hole assembly 30 is shown attached to the lower end of composite coiled tubing 20 and extending into a deviated or horizontal borehole 24. It should be appreciated that this embodiment is described for explanatory purposes and that the present invention is not limited to the particular borehole disclosed, it being appreciated that the present invention may be used for various well plans.

Figure 2:
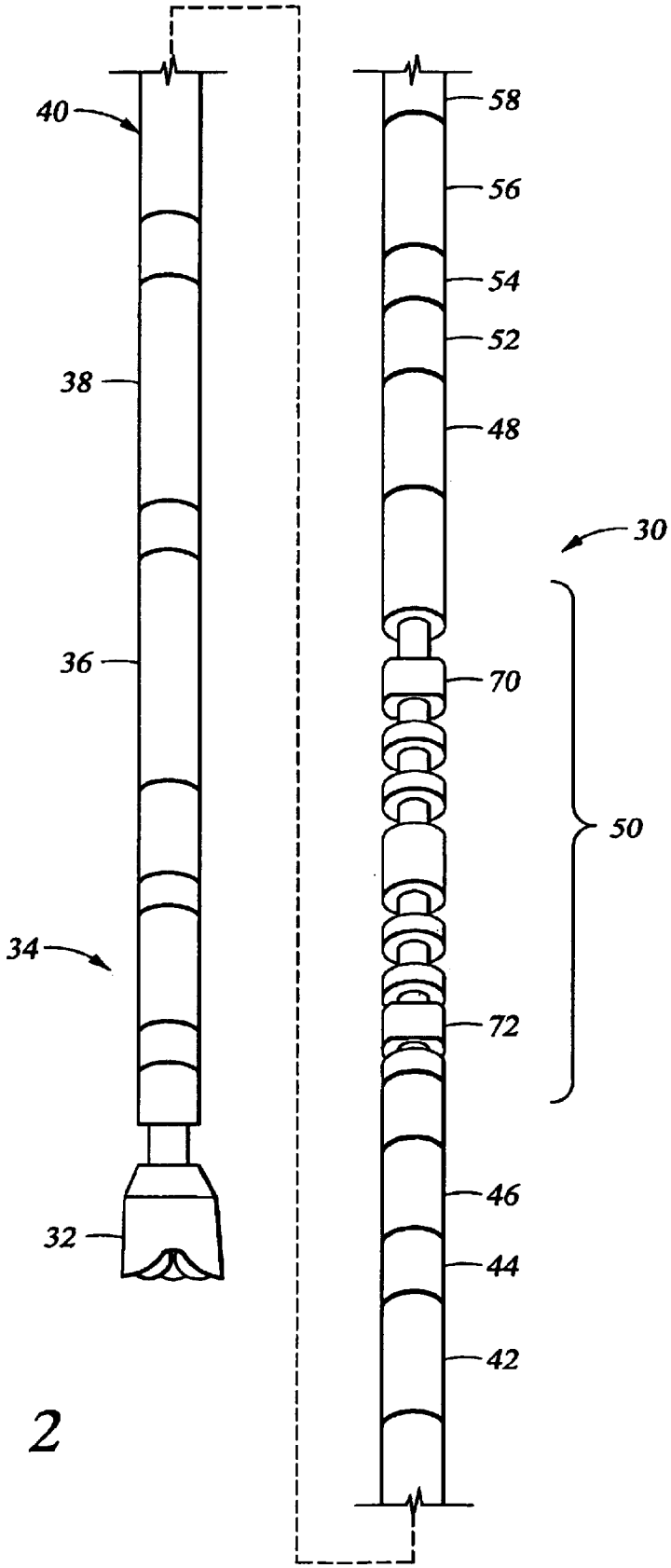
FIG. 2 is an enlarged perspective view of the bottom hole assembly shown in FIG. 1 including the propulsion system with traction modules.

As shown in FIG. 2, bottom hole assembly 30 typically includes a bit 32, a steering assembly 34, a power section 36, a resistivity tool 38, and an orientation package 40. Further, the downhole assembly 30 includes a propulsion system 50 having a lower tractor back pressure control module 42, a lower tension/compression sub 44, pressure measurement sub 46, an upper tractor back pressure control module 48, an upper tension/compression sub 52, a supervisory sub 54, and a flapper ball drop 56. The bottom hole assembly 30 is connected to a work string 58 extending to the surface 60 of the well 22.

It should be appreciated that other tools may be included in the bottom hole assembly 30. The tools making up the bottom hole assembly 30 will vary depending on the well operation to be performed. It should be appreciated that the present invention is not limited to a particular propulsion system 50 and other alternative assemblies may also be used. Further details on the individual components of the bottom hole assembly 10 and their operation may be found in U.S. provisional application Ser. No. 60/063,326, filed Oct. 27, 1997 entitled "Drilling System", U.S. patent application Ser. No. 09/081,961 filed May 20, 1998 entitled "Drilling System", and U.S. patent application Ser. No. 09/467,588 filed Dec. 20, 1999 entitled Three Dimensional Steering Assembly, all hereby incorporated herein by reference.

Figure 3:
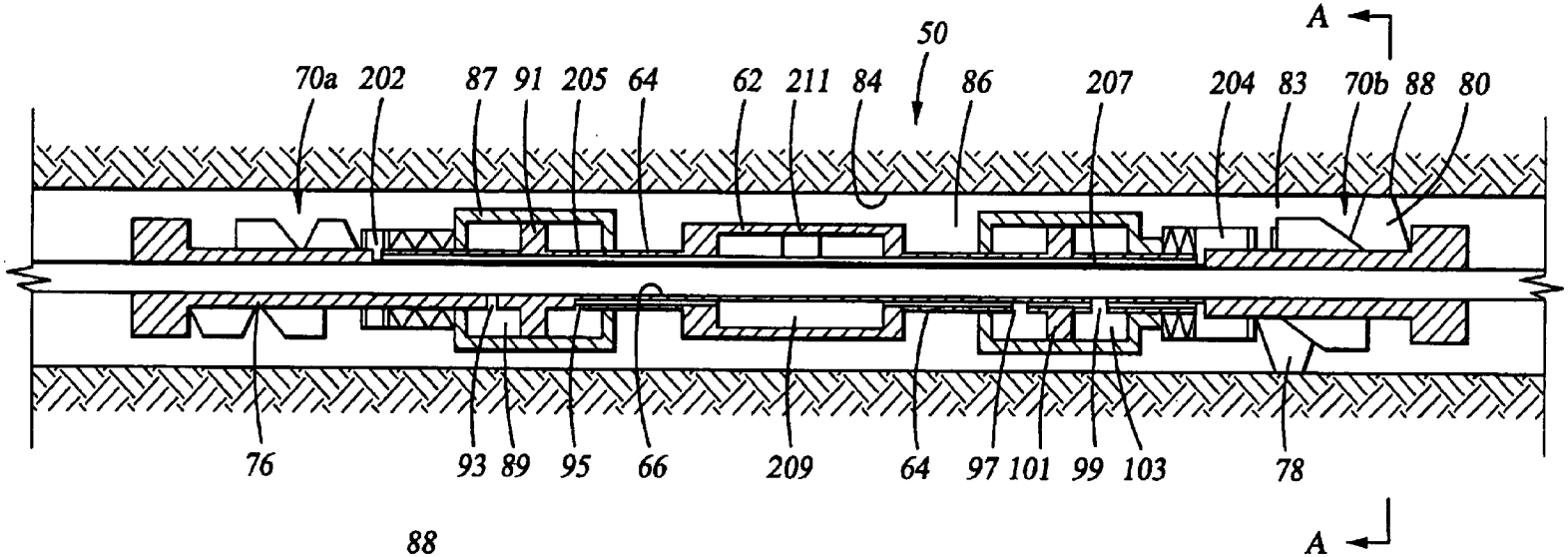
FIG. 3 is a cross-sectional schematic view of the propulsion system shown in FIG. 2.

Referring now to FIG. 3, there is shown a schematic of the propulsion system 50 which includes a housing 62 which includes a central tubular member 64 forming a flow bore 66 therethrough for the passage of drilling fluids flowing down through the composite umbilical 20 from the surface 60. For self-propulsion, propulsion system 50 includes a downstream borehole retention assembly 70*a* and an upstream borehole retention assembly 70*b*. It should be appreciated that the propulsion system 50 may include more than two borehole retention assemblies.

Figure 4:
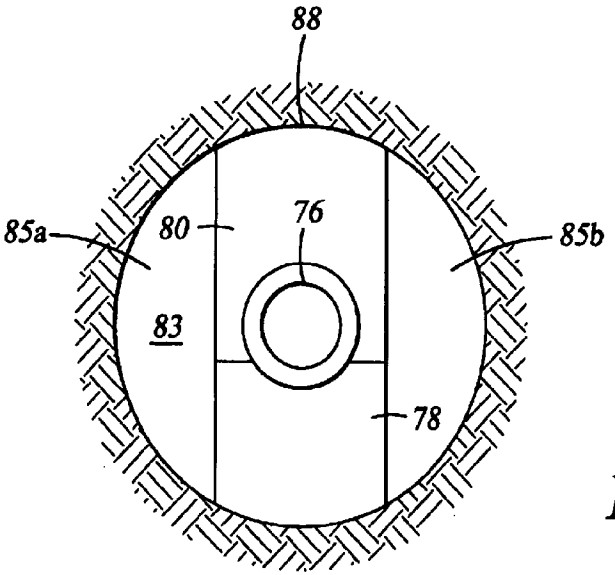
FIG. 4 is a cross-sectional view taken at plane 4—4 in FIG. 3 showing one of the borehole retention assemblies.
Figure 5:
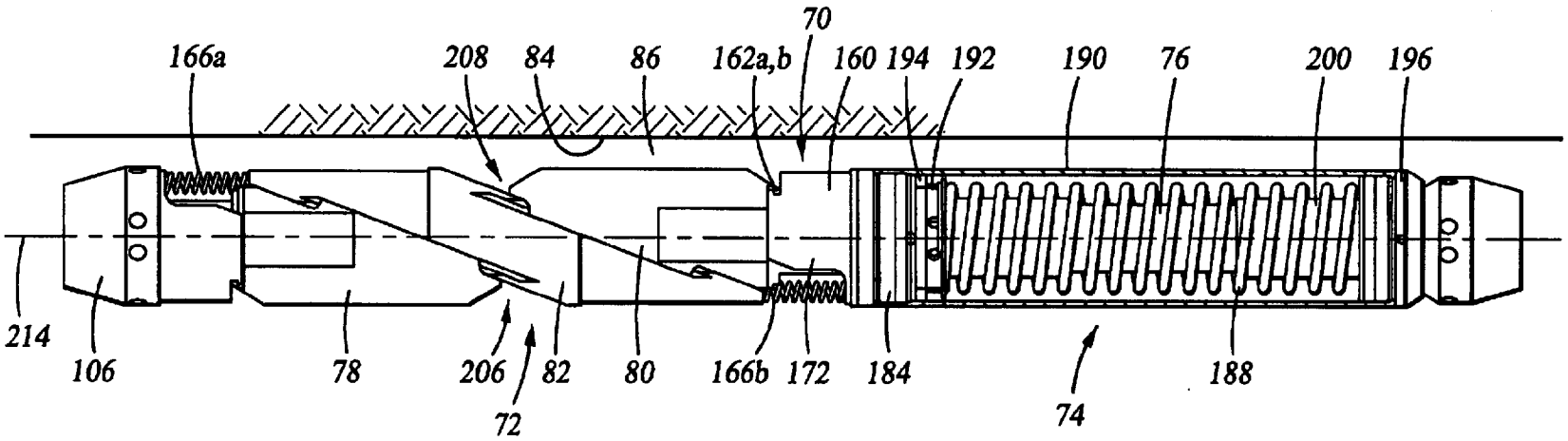
FIG. 5 is a side elevation view, partly in cross section, of a borehole retention assembly in the contracted position and constructed in accordance with a preferred embodiment of the present invention.
Figure 6:
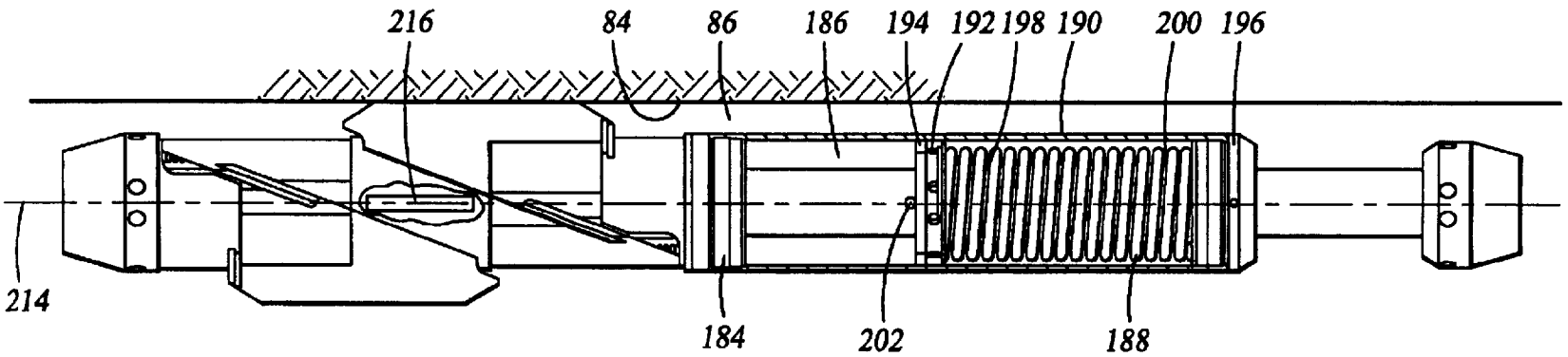
FIG. 6 is a side elevation view, partly in cross section, of the borehole retention assembly of FIG. 5 shown in the expanded position.

Referring now to FIGS. 4 and 5, in FIG. 4 there is shown a cross-section of borehole retention assembly 70*b*. Since borehole retention assembly 70*a,b* are all similar in construction, a description of one borehole retention assembly is descriptive of the others. Borehole retention assembly 70 includes a gripping assembly 72 mounted onto an actuation assembly 74 with assemblies 72, 74 both being mounted on a mandrel 76 forming a portion of a central tubular member 64 having a flow bore 66 therethrough for the passage of drilling fluids flowing down through the umbilical 20 from the surface 60. Gripping assembly 72 includes first and second end members 78, 80 with a medial member 82 disposed therebetween. Upon actuation by actuation assembly 74, first and second end members 78, 80 are cammed radially outward by medial member 82 as shown in FIGS. 4 and 6 into engagement with the wall 84 of the borehole 86. This engagement at 88 shown in FIGS. 4 and 6 end members 78, 80 with the borehole wall 84 anchors one end of the propulsion system 50. A longitudinal fluid flow passage 85*a* and *b* are provided on each side of borehole retention assembly 70 to allow drilling fluid to flow upstream through annulus 86 when gripping assembly 72 is expanded into engagement with the wall 84 of borehole 86.

Housing 62 includes a downstream housing section 87 having a tubular cylinder 89 in which is disposed a hydraulic ram 91 on which is mounted downstream borehole retention assembly 70*a*. Hydraulic ports 93, 95 are disposed at the opposite sides of ram 91 in tubular cylinder 89 for applying hydraulic pressure to ram 91. Hydraulic ports 97, 99 are disposed at opposite sides of ram 101 in tubular cylinder 103 for applying hydraulic pressure to ram 101. Hydraulic ports 202, 204 communicate with fluid passageways or lines 205, 207 extending through the wall of mandrel 76 and central tubular member 64 to a control section 209 for actuating actuation assembly 74 to expand and contract the gripping assemblies 72 in and out of engagement with the wall 84 of borehole 86. It should also be appreciated that propulsion system 50 includes a series of hydraulic valves 211 using fluid pressure and electric motors for the actuation of borehole retention assemblies 70 and/or rams 91, 101.

The cycle of propulsion system 50 includes expanding upstream borehole retention assembly 70*b* by applying hydraulic pressure through fluid line 207 and port 204 to pressurize actuation assembly 74 which actuates upstream gripping assembly 72 into engagement with the interior wall 84 of borehole 86 with the downstream gripping assembly 72 in the contracted and non-engaged position. Hydraulic pressure is then applied through hydraulic ports 99 applying pressure to upstream ram 101. As pressure is applied against ram 101 which is attached to housing 62, housing 62 moves down hole driving bit 32 downstream. Hydraulic fluid is simultaneously applied through hydraulic port 93 causing contracted downstream downstream ram 91 to move backward in cylinder 89. Downstream ram 91 moves with housing 62 moving downhole. Once the upstream ram 101 reaches the downstream end of tubular cylinder 103, it has completed its forward stroke and is contracted. Simultaneously, downstream ram 91 has now completed its travel to the upstream end of tubular cylinder 89 and it is in its reset position to start its downward stroke of bit 32. Borehole retention assembly 70*a* is then expanded into engagement with borehole 86 by applying hydraulic pressure through fluid line 205 and port 202 while bleeding hydraulic pressure from fluid line 207 and port 204 allowing upstream borehole retention assembly 70*b* to contract. As hydraulic pressure is applied through hydraulic port 95 and against downstream ram 91, propulsion system 50 strokes downwardly against bit 32. Simultaneously, upstream borehole retention assembly 70*b* is contracted and reset. The cycle is then repeated allowing the propulsion system 50 to move continuously downstream in one fluid motion and provide a downward pressure on drill bit 32.

During drilling, drilling fluids flow down the flowbore 66 of composite umbilical 20, through propulsion system 50 and flowbore 66, through power section 36, through the bit 32 and back up the annulus 83 to the surface 60. Where the power section 36 is a downhole positive displacement motor, turbine, or other hydraulic motor, the drilling fluids rotate the rotor within the stator causing the output shaft attached to the bit 32 to operatively rotate bit 32. The propulsion system 50 propels the bit 32 into the formation for drilling the new borehole 76. The only rotating portion of the bottom hole assembly 30 is the power section 36 and bit 32. The umbilical 20 and the remainder of the bottom hole assembly 30 do not rotate within the borehole 76. It should also be appreciated that the hydraulic actuation may be reversed whereby propulsion system 50 may be moved upstream in borehole 86. In other words, propulsion system 50 can walk either forward, downstream, or backward, upstream in borehole 86.

Western Well Tool, Inc. manufactures a tractor having expandable and contractible upstream and downstream packerfeet mounted on a hydraulic ram and cylinder for self-propelling drilling bits. The Western Well Tool tractor is described in a European patent application PCT/US96/13573 filed Aug. 22, 1996 and published Mar. 6, 1997, publication No. WO 97/08418, and U.S. Pat. No. 6,003,606, both hereby incorporated herein by reference.

Referring now to FIGS. 5 and 6, there is shown a preferred embodiment of the borehole retention assembly 70 for use with a propulsion system such as propulsion system 50. Gripping assembly 72 is shown mounted onto actuation assembly 74 with assemblies 72, 74 both being mounted on mandrel 76 having a flow bore 66 therethrough for the passage of drilling fluids flowing down through the umbilical 20 from the surface 60.

Figure 7:
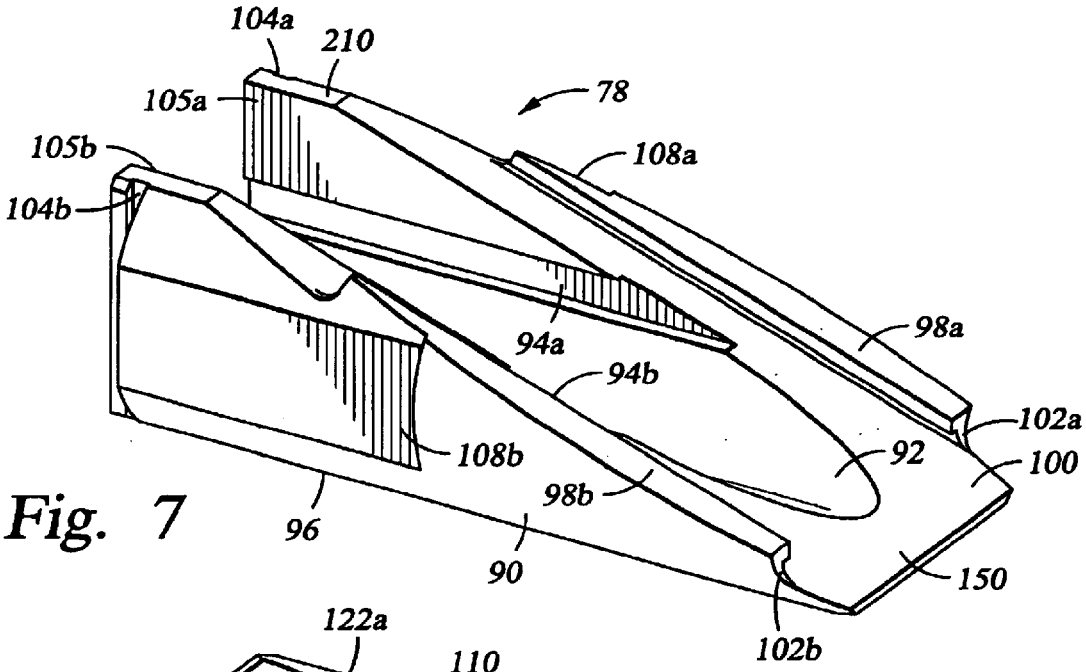
FIG. 7 is a perspective view of one of the end members of the gripping assembly forming a part of the borehole retention assembly of FIG. 5.

Referring now to FIG. 7, first end member 78 has a housing 90 which is generally U-shaped forming an arcuate cut out portion 92 for slidingly receiving mandrel 76 and for radially reciprocating with respect to mandrel 76. Cut out portion 92 includes a pair of oppositely disposed grooves or slots 94*a, b* for receiving a pair of keys 216 disposed on mandrel 76 to prevent relative rotation therebetween. The exterior surface 96 of housing 90 is generally cylindrical terminating in parallel tapered rails 98*a,b* and the internal surface 100 forms a wedge surface also tapered and parallel with tapered rails 98*a,b*. Rails 98*a,b* form tracks 102*a,b* with internal wedge surface 100 for attachment to medial member 82 as hereinafter described. End rails 104*a,b* are provided perpendicular to the axis of housing 90 for attachment to an end collar 106 as hereinafter described. Side flats 108*a,b* are provided on each side of housing 90 to receive a shroud or shield 110 as hereinafter described.

Figure 8:
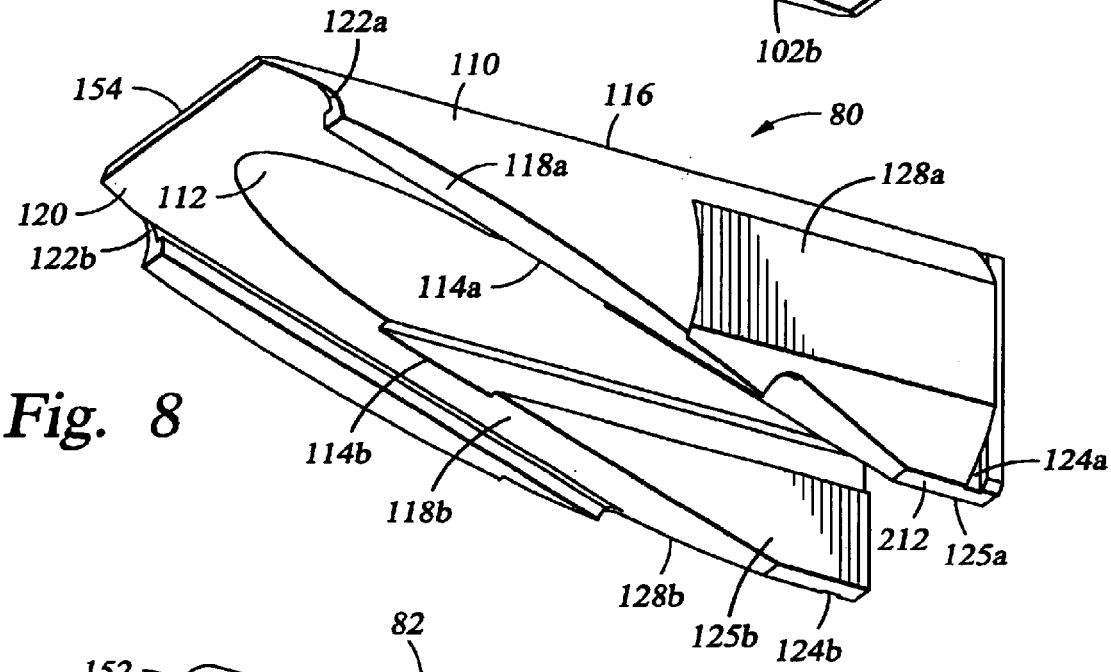
FIG. 8 is a perspective view of the other one of the end members of the gripping assembly forming a part of the borehole retention assembly of FIG. 5.

Referring now to FIG. 8, likewise, second end member 80 has a housing 110 which is generally U-shaped forming an arcuate cut out portion 112 for slidingly receiving mandrel 76 and for radially reciprocating with respect to mandrel 76. Cut out portion 112 includes a pair of oppositely disposed grooves or slots 114*a,b* for receiving a pair of keys 216, shown in a cut away view in FIG. 5, disposed on mandrel 76 to prevent relative rotation therebetween. The exterior surface 116 of housing 110 is generally cylindrical terminating in parallel tapered rails 118*a,b* and the internal surface 120 forms a wedge surface also tapered and parallel with tapered rails 118*a,b*. Rails 118*a,b* form tracks 122*a,b* with internal wedge surface 120 for attachment to medial member 82 as hereinafter described. End rails 124*a,b* are provided perpendicular to the axis of housing 110 for attachment to actuation assembly 74 as hereinafter described. Side flats 128*a,b* are provided on each side of housing 110 to receive a shroud or shield 110 as hereinafter described.

Arcuate cut out portions 92, 112 of end members 78, 80, respectively, provide under cuts dimensioned to slidingly receive mandrel 76 and to be flush against the outer surface of mandrel 76. As shown in FIGS. 5 and 6, the inwardly facing edges 210, 212 of end members 78, 80, respectively, extend past the axis 214 of mandrel 76 in both the expanded and contracted positions. This allows the end members 78, 80 to achieve a maximum expansion with a minimum class diameter that they can be achieved down hole for a particular borehole. The fact that the end members 78, 80 are able to wrap around mandrel 76 and engage the tapered surfaces 136, 138 of medial member 82 on the side on mandrel 76 rather than on the top or bottom of mandrel 76 permits end members 78, 80 to increase their radial movement as compared to those embodiments which are mounted on the top and bottom of the mandrel. Thus, the preferred embodiment provides longer tapered surfaces 100, 136 and 138, 120 than is available in the prior art where the expansion members are mounted on one side of the mandrel. The preferred embodiment provides an extended area on each side of the mandrel 76 as well as the expansion area on the top and bottom of the mandrel 76 to allow end members 78, 80 to fully contract and fully expand. In one preferred embodiment, end members 78, 80 collapse to a diameter of 4.25 inches and expand to a diameter of 6.289 inches thereby achieving approximately a 50% expansion.

The preferred embodiment also provides additional camming surface on tapered surfaces 100, 136 and 138, 120. A larger area of engagement between the engaging surfaces of members 78, 80, 82 reduces the stresses between the surfaces. Further the preferred embodiment has only two points of contact.

Additionally the area of cylindrical outer surfaces 96, 116 of end members 78, 80 is large so that sufficient surface area engages the borehole wall 84 so as not to crack the borehole wall 84. The contact stress is reduced with the larger contact area with the borehole wall 84 because the force is distributed over a larger surface area.

Each of the outer cylindrical surfaces 96, 116 of end members 78, 80 preferably have a roughened surface for gripping the borehole wall 84. The roughened surface may include a knurled surface, a fluted surface, a surface with projections such as buttons or beads, a tread, a hard facing surface or any other surface for gripping engagement with the borehole wall 84.

Figure 9:
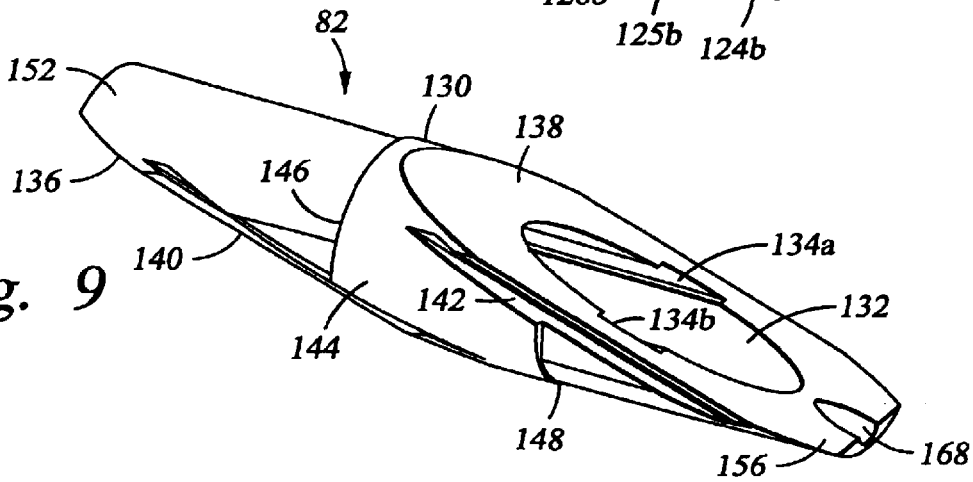
FIG. 9 is a perspective view of a medial member disposed between the end members shown in FIGS. 7 and 8.

Referring now to FIG. 9, the medial member 82 has a generally cylindrical housing 130 with a cylindrical bore 132 therethrough for receiving mandrel 76. Like members 78, 80, medial member 82 includes a pair of oppositely opposed slots 134*a,b* extending through bore 132 which receive the pair of keys 216 mounted on the outer surface of mandrel 76 to prevent relative rotation therebetween while allowing axial movement of medial member 82 on mandrel 76. Housing 130 has complimentary tapered ends 136, 138 for sliding engagement with tapered internal surfaces 100, 120, respectively, of members 78, 80. Further, medial member 82 has two sets of tracks 140 and 142 on each side thereof for inter-engagement with tracks 94*a,b* and 118*a,b* on end members 78, 80 for the sliding attachment of end members 78, 80 to medial member 82. The central portion 144 of medial member 82 has an enlarged diameter forming a pair of arcuate shoulders 146, 148 for engagement with shields 110 as hereinafter described.

In the assembly of gripping assembly 72, the pair of tracks 98*a,b* of end member 78 inter-engage the complimentary pair of tracks 140 of medial member 82 as shown in FIG. 5. It can be seen in assembling end member 78 and medial member 82, end 150 of end member 78 is aligned with end 152 of medial member 82 such that the track pair 98 is aligned with track pair 140 such that end member 78 is slid onto medial member 82. The tracks form a tongue and groove sliding connection. As shown, tapered surface 100 of end member 78 slidingly engages tapered surface 136 of medial member 82. Likewise, end 154 of end member 80 is aligned with end 156 of medial member 82 such that track pair 118 is aligned with track 142 such that end member 80 is slid onto medial member 82. As with end member 78, tapered surface 120 of end member 80 slidingly engages tapered surface 138 of medial member 82. It can be seen that relative movement of end members with respect to medial member 82 will cause the tapered wedge surfaces 100, 140 and 120, 142 to cam end wedges outwardly as the assembly 72 is compressed and inwardly as the assembly 72 is expanded by actuation assembly 74.

Referring now to FIGS. 5 and 10–12, first end collar 106 includes a pair of tracks 158*a,b* for inter-engagement with complimentary tracks 104*a,b* on end member 78. Likewise, a second end collar 160 connected to actuation assembly 74, includes a pair of tracks 162 for inter-engagement with complimentary tracks 124*a,b* on end member 80. End collars 106, 160 have bores, such as bore 164 in collar 106, for receiving mandrel 76 and are permanently attached to mandrel 76 such that they do not move relative to mandrel 76.

Figure 10:
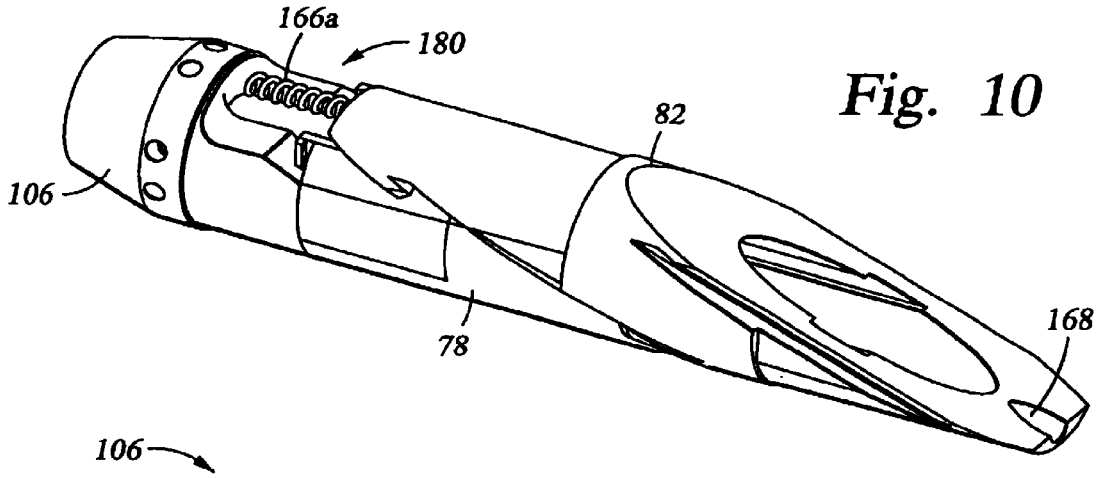
FIG. 10 is a perspective view on the end member of FIG. 7 mounted on an end collar.
Figure 11:
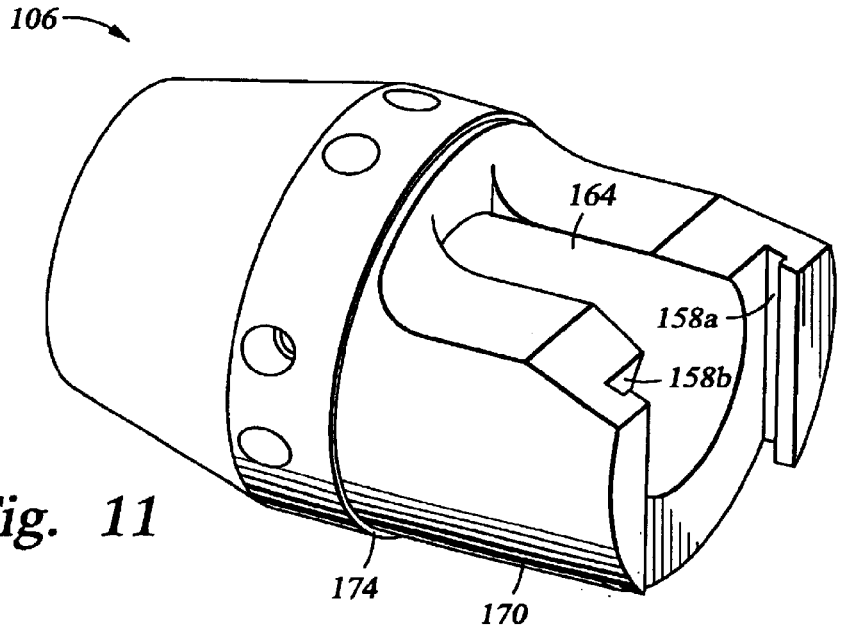
FIG. 11 is a perspective view of the end collar of FIG. 10.

As shown in FIGS. 5 and 10, preferably individual springs 166*a,b* are disposed between end collar 106 and medial member 82 and between end collar 160 and medial member 82 to assist in moving end members 78, 80 from their expanded to their contracted positions. It should be appreciated that a plurality springs 166*a,b* may be used at each end of gripping assembly 72. Medial member 82 has recesses, such as recess 168, for housing one end of springs 166*a,b*. As actuation assembly 74 contracts gripping assembly 72 by applying an axial force toward first end collar 106, the shallow angle of tapered surfaces 100, 136 and 120, 138 provides a mechanical advantage in moving end members 78, 80 to their radially expanded position. However, this mechanical advantage works against moving end members 78, 80 to their collapsed position due to friction between the tapered surfaces. Springs 166*a,b* balance the forces on medial member 82 and prevent members 78, 80, 82 from cocking where they might lock up or stick and not fully retract into their contracted positions.

Figure 12:
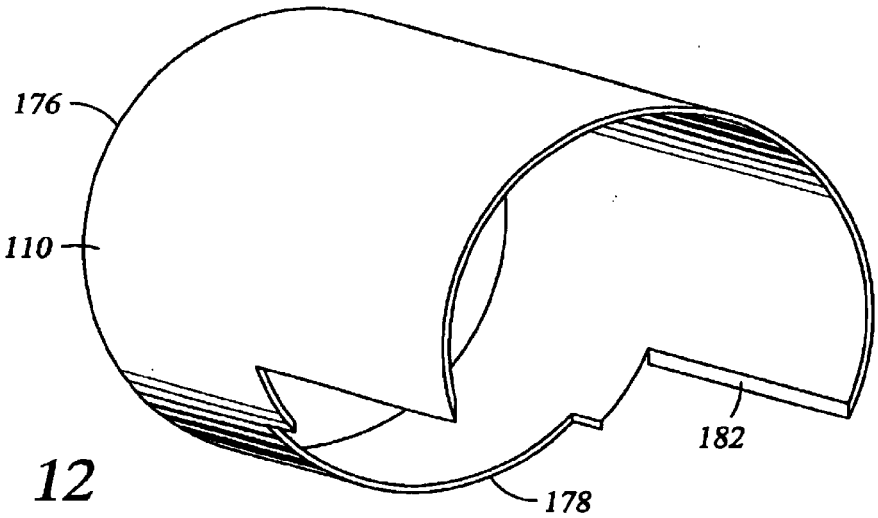
FIG. 12 is a perspective view of a shroud for covering one end of the end members.

Referring now to FIG. 12, shields 110 are received over the reduced diameter ends 170, 172 of end collars 106, 160, respectively. Shields 110 are attached, such as by bolting, to end collars 106, 160. The reduced diameter forms shoulders, such as shoulder 174 on end collar 106, for engaging one end 176 of shield 110. Shield 110 is generally cylindrical having a cut out portion 178 dimensioned to receive reduced diameter ends 170, 172 and permit the radial movement of end members 78, 80 from their contracted to their expanded position. Shields 110 have been omitted from FIGS. 5 and 6 for purposes of clarity. Cut out portions 178 serve as shrouds to cover open portions 180 shown in FIG. 10 and have edges 182 which have a sliding fit along flats 108, 118 and allow end members 78, 80 to translate radially outward into the expanded position. Shields 110 extend slightly beyond 90° on end side of end members 78, 80 and may be approximately 100° from the top. Shields 110 avoid exposing void or opening 180 between end members 78, 80 and medial member 82 which would allow cuttings, debris or other deleterious to get inside the gripping assembly 72 and contaminate camming surfaces 100, 136 and 120, 138 of members 78, 80, 82.

During assembly, the end tracks 12*a,b* of end member 80 are slid into end tracks 162*a,b* of end collar 160. The tapered tracks 118*a,b* of end member 80 are then slid onto tapered tracks 142 of medial member 82. The tapered tracks 140 of medial member 82 are then slid onto tapered tracks 94*a,b* of end member 78. The end tracks 104 of end member 78 are then engaged with the end tracks 158*a,b* of end collar 106. Keys 216, shown in FIG. 6, are assembled onto mandrel 76. With members 78, 80, 82 assembled with end collars 106, 160, the mandrel 76 with keys 216 are then inserted into the openings through these members and collars to complete the assembly. Aligned slots 94*a,b*, 134, 114 receive keys 216 to prevent the assembly of members 78, 80, 82 from rotating on mandrel 76 while allowing axial movement. The downhole motor 36 rotating the bit 32 places a torque on the mandrel 76 such that key 216 then translates that torque to members 78, 80, 82. The gripping assembly 72 must not only grab onto the borehole wall 84 to allow axial thrust, but also must prevent torsional or rotational movement of the propulsion system 50. Thus, it resists the reaction torque on the propulsion system 50 caused by the down hole motor 36.

In operation, the control section 209 of the propulsion system 50 operates the spool valve 211 to actuate a first gripping assembly 72 while deactivating a second gripping assembly 72. The spool valve 211 pressurizes the first fluid line 205 and cylinder 186 causing first piston 184 to move end member 80 along wedge surfaces 120, 138 until end member 80 has reached the limit of its travel and been completely cammed outwardly into engagement with the borehole wall 84. End member 80 then engages the end of medial member 82 causing medial member 82 to move axially and cause end member 78 to move along wedge surfaces 136, 100 until end member 78 has reached the limit of its travel and been completely cammed outwardly into engagement with the borehole wall 84. The axial contracting movement of members 78, 80, 82 continues until medial member 82 contacts end collars 106, 160 or cut out portions 198, 200 make contact to limit further axial movement and thereby limit the expanded positions of end members 78, 80. As shown in FIG. 5, end member 78 translates radially outward in one radial direction while end member 80 translates radially outward in the opposite radial direction. It can be appreciated that flow areas are provided on each side of end members 78, 80 and medial member 82 for flow up through the annulus 84. With the members 78, 80, 82 in the extended position, return flow up the annulus 84 is approximately at 90° from the members.

As shown in FIGS. 3, 5 and 6, simultaneously, the second gripping assembly 72 is moving to its collapsed or contracted position shown in FIG. 5. The spool valve 211 allows the high pressure fluid in the second fluid line 207 and second cylinder 186 to bleed off allowing second return spring 188 to push against one end of cylinder 186 which causes the other end of cylinder 86, attached to second end member 80, to pull second end member 80 along opposed tapered surfaces 120, 138 to its contracted position. In its fully contracted position, second end member 80 then begins to pull on medial member 82 which in turn engages and pulls on first end member 78 along opposing tapered surfaces 136, 100 causing end member 78 to move to its contracted position.

As can be seen in FIGS. 5 and 6, all members 78, 80, 82 are exposed to the annulus 83 and therefore the fluids flowing through the annulus 83. As members 78, 80 translate onto medial member 82, any debris which is in the areas 206, 208 is wiped off as tapered surfaces 120, 138 and 100, 136 translate against each other. Tapered surfaces 100, 120 of end members 78, 80 extend beyond cuts out portions 92, 112 to avoid debris getting between end members 78, 80 and mandrel 76. Thus tapered surfaces 100, 136 and 120, 138 scrape any debris that is accumulated on surfaces 136, 138 of medial member 82.

Referring again to FIGS. 5 and 6, actuation assembly 74 includes a piston 184 reciprocably disposed in a cylinder 186 with a return spring 188. Piston 184 is bolted to end collar 160 for moving gripping assembly 72 axially along mandrel 76 as actuation assembly 74 expands and contracts. Cylinder 186 is formed between mandrel 76, an outer sleeve 190 and a fixed end 192. Fixed end 192 is attached to mandrel 76 such that fixed end remains stationary and does not move on mandrel 76. End 192 includes one or more sealing members 194 in sealing engagement with the inner surface of outer sleeve 190. Outer sleeve 190 has one end fixed to piston 184 and another end fixed to a movable end 196. Outer sleeve 190, fixed end 192 and movable end 196 form a cage housing return spring 188. Fixed and movable ends 192, 196 may have cylindrical skirts 198, 200 extending around mandrel 76 to protect mandrel 76 from contacting springs 188 whereby springs 188 may damage the outer surface of mandrel 76. The skirts 198, 200 may have engaging ends in the spring contracted position shown in FIG. 5 to serve as a limit to the axial movement of piston 184 towards end collar 106.

Piston 184 and movable end 196 are slidably disposed on mandrel 76 extending through the propulsion system 50. Port 202 and fluid line 205 extends through the wall of mandrel 76 to central control module 209 in propulsion system 50. As hydraulic pressure is increased in cylinder 186, piston 184, outer sleeve 190 and movable end 196 move as a unit toward end collar 106. As movable end 196 moves toward fixed end 192, gripping assembly expands as shown in FIG. 6 and return spring 188 compresses between fixed end 192 and movable end 196 until the ends of skirts 198, 200 engage shoulders to limit the movement of piston 184. Upon venting the hydraulic pressure in cylinder 186, return spring 188 bears on fixed end 192 and movable end 196 causing outer sleeve 190 of cylinder 86 to pull collar 160 and piston 184 away from members 78, 80, 82. This causes actuator assembly 74 to pull second end member 80 and medial member 82 apart and then pull first end member 78 and medial member 82 apart into their contracted position shown in FIG. 5. Surfaces 105*a, b* and 125*a, b* (FIGS. 7 and 8) make sliding contact with mandrel 76 to prevent debris from entering into the void area between arcuate cut out portions 98, 112 and mandrel 76.

The propulsion system preferably includes a central control section 209 which, among other functions, controls the hydraulic valving 211 in the system 50, typically disposed inside the housing 62 of the propulsion system 50. Where the propulsion system 50 includes two gripping assemblies 72, a single hydraulic valve 211, typically located near the middle of the propulsion system 50, communicates with a first fluid line 205 extending through the wall of mandrel 76 from the valve 211 to a first port 202 communicating with a first cylinder 186 in a first gripping assembly 72 and with a second fluid line 207 extending through the wall of mandrel 76 from the valve 211 to a second port 202 communicating with a second cylinder 186 in a second gripping assembly 72. The valve 211 is preferably a two-way spool valve which opens one of the first and second fluid lines 205, 207 while venting the other of the first and second fluid lines 205, 207. When the first fluid line 205 is open, high pressure fluid passes from the flowbore 66 through mandrel 76, through the first fluid line 205 and port 202, and into first cylinder 186 to actuate first gripping assembly 72. Simultaneously, the valve 211 vents the high pressure fluid in the second fluid line 207 into the annulus 86 allowing second return spring 188 to retract the piston 184 in the second gripping assembly 72. The ports 202 and fluid lines 205, 207 through the wall of mandrel 76 not only allows high pressure fluid to actuate the first piston 184 but also is used to bleed off the high pressure fluid out into the annulus 86 to allow the second piston 184 to be retracted by second spring 188. This allows one valve 211 in the control housing 209 to operate both gripping assemblies 72 such that the valve 211 energizes and pressures up one gripping assembly 72 while it de-energizes and bleeds off the high pressure fluid in the other gripping assembly 72 while they work in tandem. Fluids are pumped from the surface through mandrel 76 with the returns flowing up the annulus 83.

One example of a propulsion system is disclosed in Western Well Tool International Application Publication No. WO 97/08418, published Mar. 6, 1997 and entitled "Puller-Thruster Downhole Tool", hereby incorporated herein by reference. FIGS. 3 and 4 of that application show a center control section and hydraulic valving. Although FIGS. 3 and 4 show multiple passages formed by concentric cylinders, preferably the fluid lines through the wall of the mandrel are gun drilled. Although the application discloses actuating the valves hydraulically, preferably the valves are actuated using electric motors. The electric motors are attached to the spool valve moving the spool valve between positions. In the application, springs allow the valve to open at a certain pressure. When the piston reaches the end of its travel, pressure builds up in a pressure cavity causing another spring to open the valve and bleed off the pressure.

Figure 13:
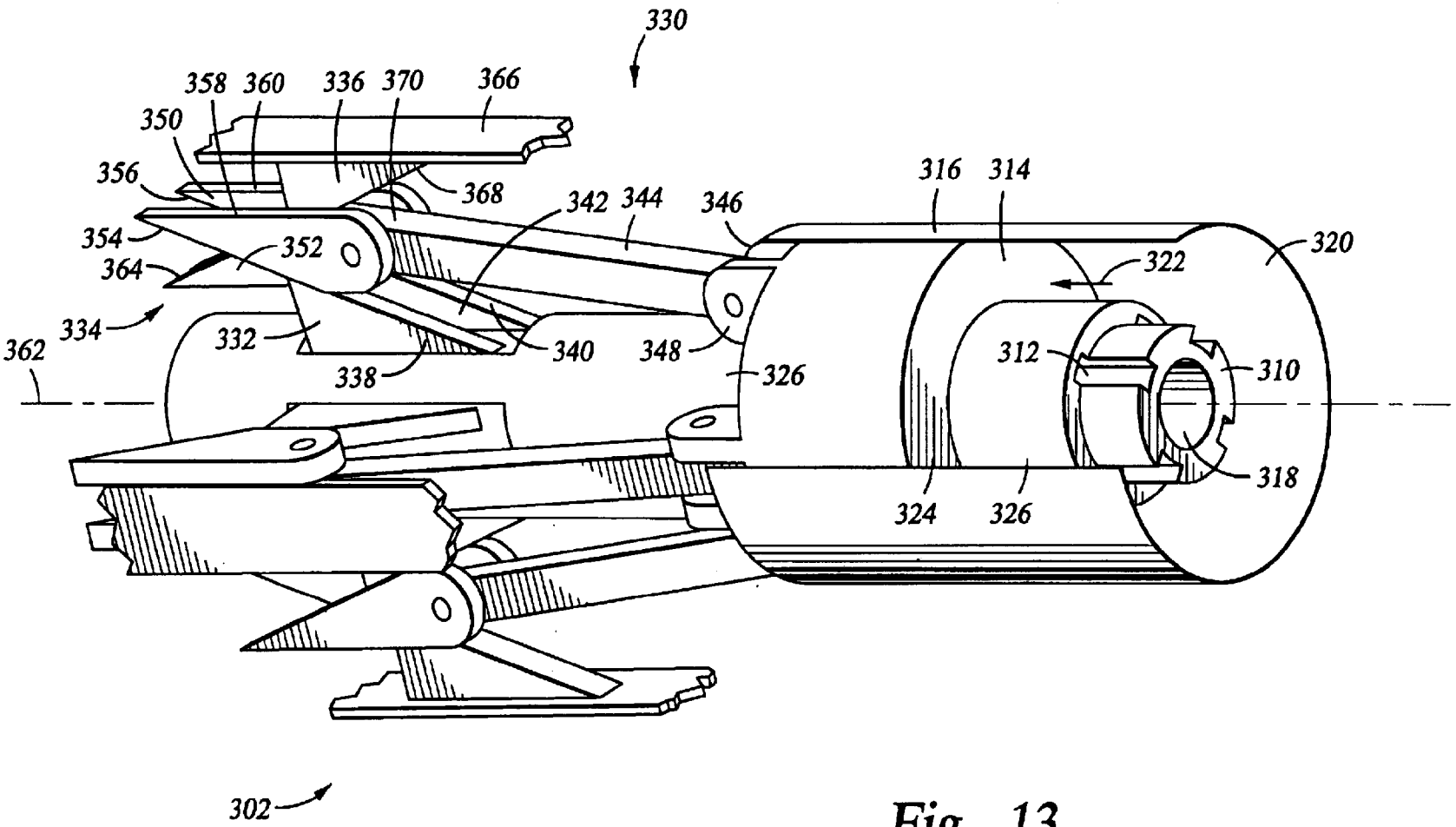
FIG. 13 is a perspective view, partly in cross section, of an alternative embodiment of the borehole retention assembly in the expended position.

Referring now to FIG. 13, a preferred embodiment of the retention module or wedge anchor 302 of the present invention is shown. Wedge anchor 302 can be used as either upstream 70*a* or downstream 70*b* borehole retention assembly for use on propulsion system 50 to perform an operation within well 22. Anchor 302 is deployed on each end of propulsion system 50 to alternately engage the borehole wall 84. Typical propulsion systems are described in European patent application PCT/US96/13573 filed Aug. 22, 1996 and published Mar. 6, 1997, publication No. WO 97/08418, and U.S. Pat. No. 6,003,606, and in patent application Ser. No. 09/081,961 filed May 20, 1998 entitled Drilling System, all hereby incorporated herein by reference.

Anchor 302 includes a flow tube 310 disposed on propulsion system 50. Flow tube 310 is splined at 312 to a mandrel 326 disposed within a piston 314 and a cylinder 316. Cylinder 316 is a fixed outer tube and is preferably configured to allow piston 314 to slidably reciprocate therein. Spline 312 may include mating grooves on flow tube 310 and mandrel 326 with a key disposed within the aligned slot formed by the grooves and prevents mandrel 326 from rotating with respect to flow tube 310. Fluid flowing through a flowbore 318 in flow tube 310 is bled into a chamber 320 formed by mandrel 326, piston 314 and cylinder 316. This hydraulic pressure is applied in direction 322 to the face 324 of piston 314. This causes piston 314 to move in the direction of arrow 322 on mandrel 326.

A plurality of gripper elements 330 are disposed around the periphery of each anchor 302 and connected to piston 314 through linkages 344. Gripper elements 330 are configured to engage borehole 86 when piston 314 is actuated by propulsion system 50. Since arms 330 are substantially identical, a description of one gripper element 330 will also be a like description of the other gripper elements 330. Preferably, there are four gripper elements 330 equally spaced about the periphery of mandrel 326, each gripper element 330 including a pair of inner wedges 332, a set of medial wedges 334, and an outer wedge member 336.

The pair of inner wedges 332 is preferably mounted around mandrel 326 forming first and second wedge surfaces 338, 340 with a slot 342 therebetween. Medial wedge set 334 is rotatably mounted on the end of a link 344 by clevis and pin arrangement 370. Link 344 in turn is pivotally mounted to end 346 of piston 314 by another clevis connection 348. Medial wedge 334 includes a pair of inward-facing wedges 350 and an outward-facing middle wedge 352 fixedly attached between wedges 350. Wedge 352 is preferably an inverted counterpart to inner wedge 350. Wedges 350 include inwardly facing cam surfaces 354, 356 and outer surfaces 358, 360 which are generally parallel to the axis 362 of flow tube 310 while middle wedge 352 has an outwardly facing cam surface 364.

Outer wedge member 336 is mounted on a spring member 366, such as a bow spring, and includes an inwardly facing cam surface 368 which engages outwardly facing cam surface 364 on middle wedge 352. Preferably, bow springs 366 are fixedly pinned at one end on the outside of the assembly and are mounted on a sliding connection at their other end. The sliding end is fixed to the piston assembly.

Figure 14:
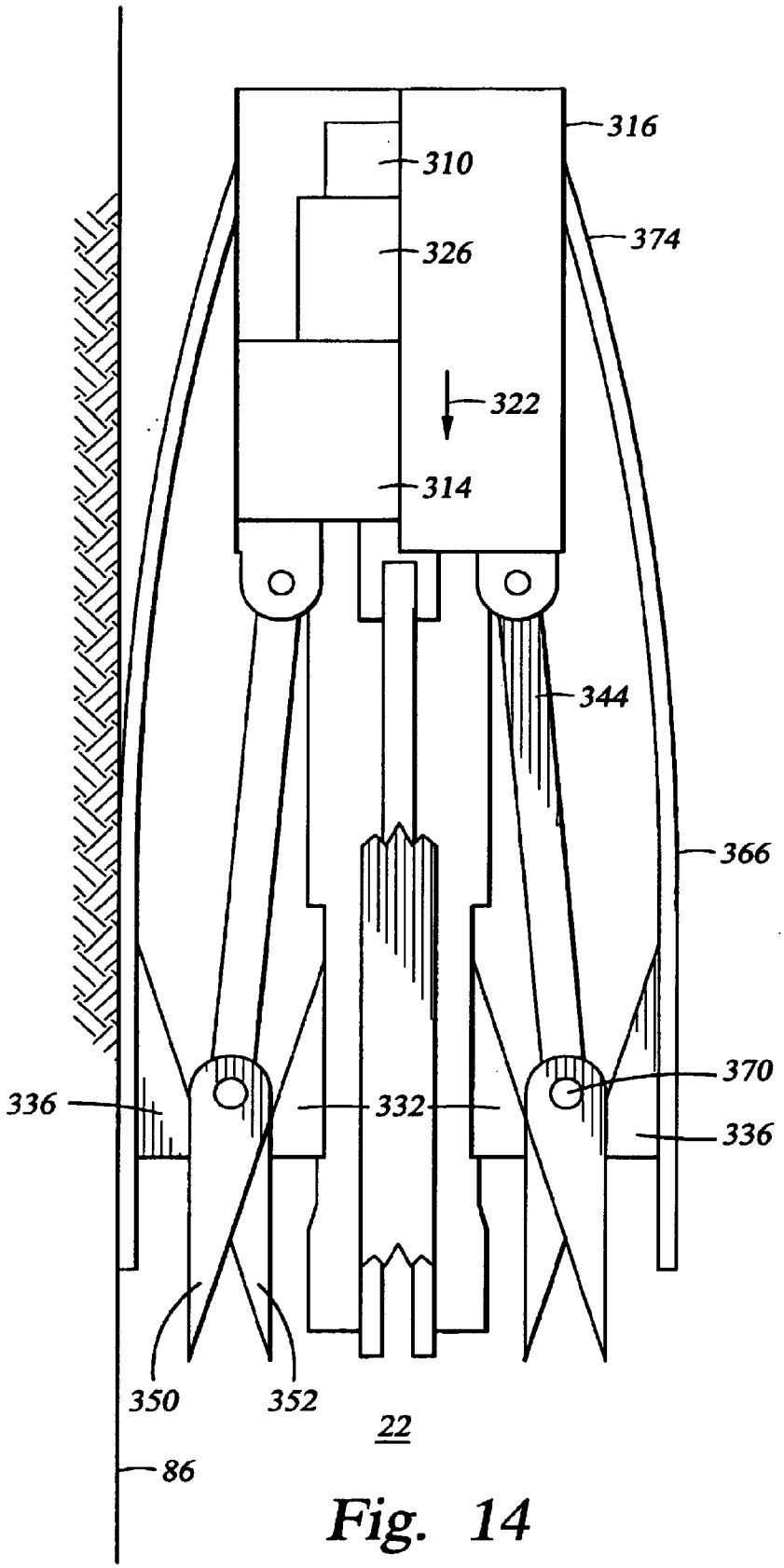
FIG. 14 is a side elevation view of the borehole retention assembly of FIG. 13 in the expanded position.

Referring now to FIG. 14, in actuating anchor 302, hydraulic pressure displaces piston 314 in direction 322, transferring load from piston 314, through linkages 344 and to medial wedge set 334. The three wedges 350, 352 of medial wedge set 334 are preferably mounted on a pivot pin of clevis connection 370. Once loaded in direction 322, medial wedge set 334 acts to open bow springs 366 by energizing wedges 332 and 336 by a camming action upon load surfaces of corresponding medial wedges 350 and 352, respectively. Because wedge set 334 contains two wedges 350, 352 that act simultaneously, the expansion of bow spring 366 is substantially double that of a comparable single wedge system, with an equal piston 314 stroke.

Bow springs 366 are preferably slidably connected to the upstream end of anchor 302 at 374 and are forced outwardly into engagement with the earth wall 84 of the borehole 86. The other end of bow springs 366 are preferably connected to the downstream end of anchor 302 at 376.

Figure 15:
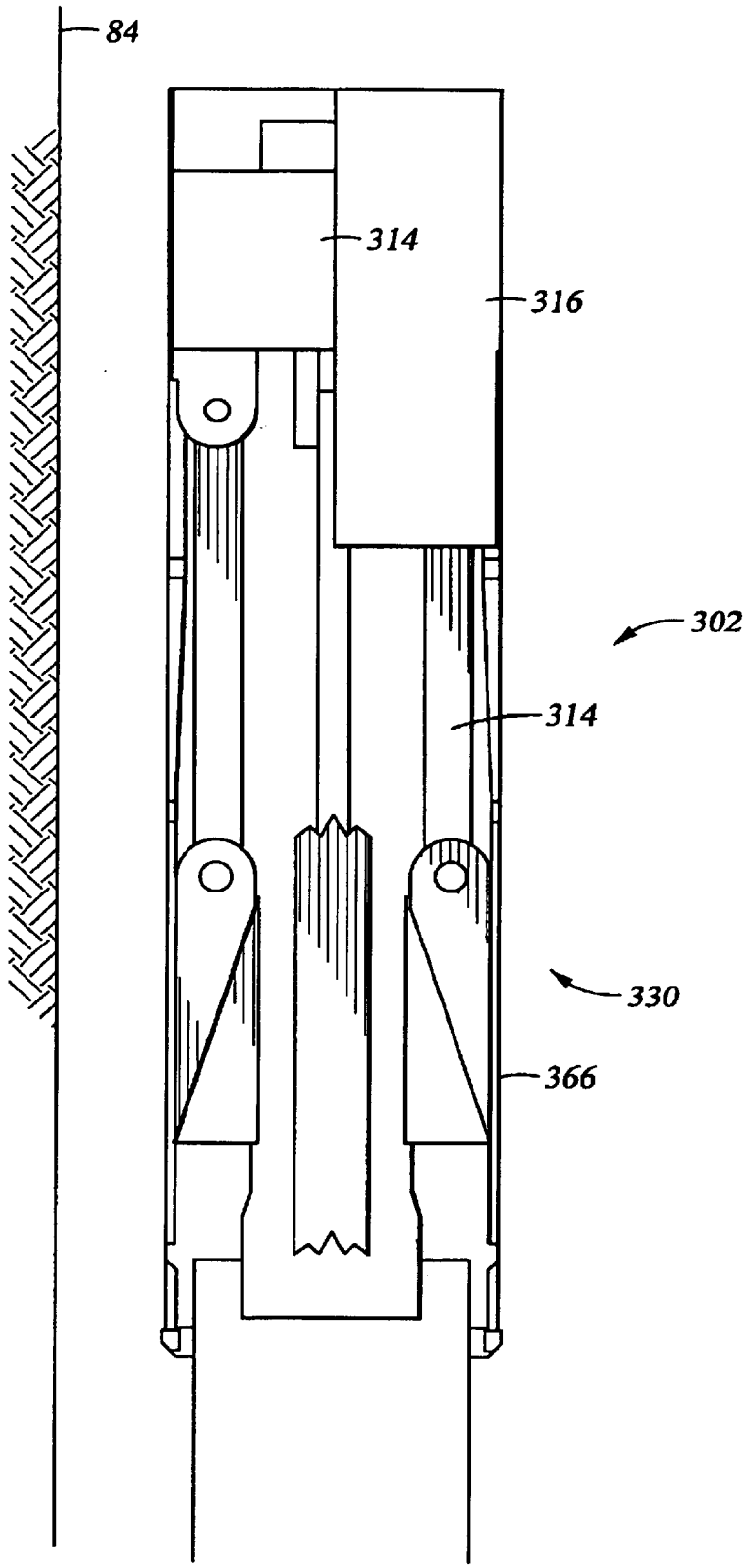
FIG. 15 is a side elevation view of the retention module of FIG. 13 in the retracted position.

Referring now to FIG. 15, the gripper element 302 is shown in the collapsed or contracted position. The stored mechanical energy of the hydraulic pressure is used to move piston 314 to the unactuated and upstream position while contracted springs 366. Once piston 314 is retracted, linkage 344 retracts medial wedge set 334 as well. Once medial set 334 is retracted, middle wedge 352 is retracted within slot 342 between inner wedge members 338, 340 while outer wedge 336 is nestled within a slot formed between wedges 350. With middle wedges 350, 352 retracted, bow springs 366 become de-energized and automatically retract away from the borehole wall 84. Because of the aforementioned double wedge extension method and the ability to retract wedges within gaps between other wedges, the contracted height (outer diameter) of the anchor 302 can be minimized, preferably substantially equal to the outer diameter of cylinder 316. It is preferable that outer diameter of anchor 302 collapses down to a diameter of approximately four inches. A typical borehole might be 4¾ inches diameter but due to borehole washouts and irregularities, anchor 302 must preferably be capable of expanding up to 6.2 inches in diameter thereby allowing the gripper elements 330 to move up to approximately two inches diametrically.

The primary advantage of the greater expansion of the double wedged system of FIGS. 13–15 versus a single wedge system is that a wide range of motion of gripper elements 330 is possible without requiring a large gage diameter of anchor 302. Another primary advantage realized by a system in accordance with the present invention is a substantially unobstructed annular flowpath. Systems in accordance with the prior art would substantially block the annulus formed between the borehole and the propulsion module, reducing the effectiveness of drilling operations. By incorporating a system by which extended bow springs are utilized, there is little obstruction to restrict annular flow from the wellbore to the surface of the well.

Figure 16:
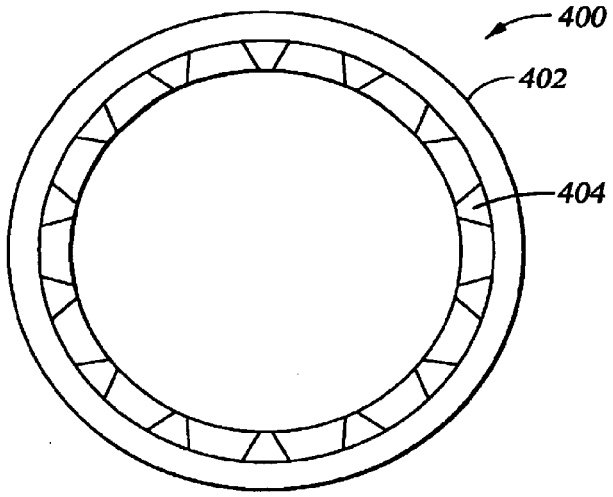
FIG. 16 is a cross sectional view of still another embodiment of the borehole retention assembly.

Referring now to FIG. 16, there is shown a still another embodiment of the borehole retention assembly 400. Since borehole retention assemblies 400 are similar in construction, a description of one assembly approximates the description of the other. Borehole assembly 400 preferably includes steel feet 402 around its outer circumference which may be expanded and contracted into engagement with the wall of borehole 86. A plurality of longitudinal fluid flow passages 404 are provided around the inner circumference of the steel bands forming feet 402 to allow drilling fluid to flow upstream through annulus 83 when borehole retention assembly 400 is expanded into engagement with the wall 84 of borehole 86. Borehole retention assemblies 400 may have independently inflatable, individual chambers for expanding assemblies 400 eccentrically with respect to the housing 62.

Figure 17:
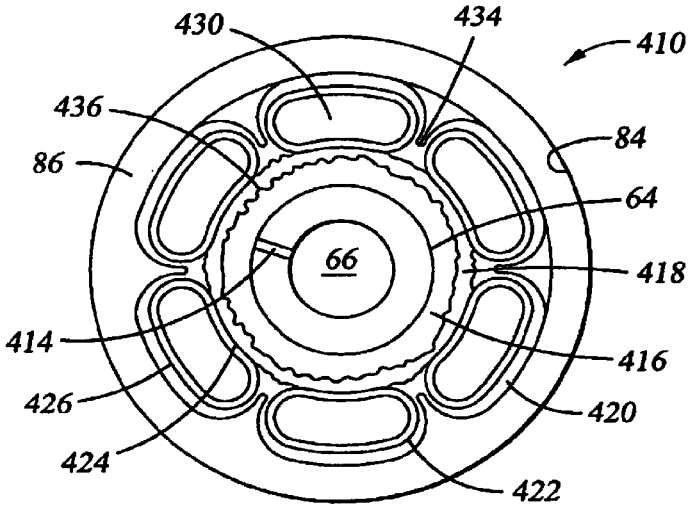
FIG. 17 is a cross sectional view of yet another embodiment of the borehole retention assembly shown in FIG. 16 in the contracted position.
Figure 18:
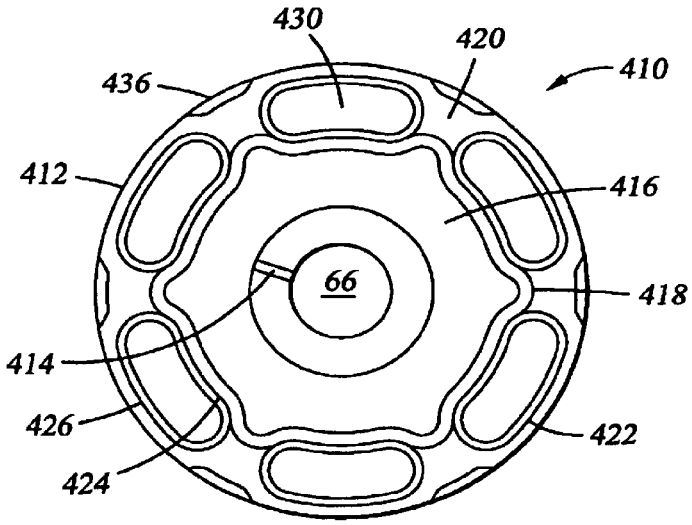
FIG. 18 is a cross sectional view of the borehole retention assembly shown in FIG. 17 in the expanded position.

FIGS. 17 and 18 are alternative embodiments of the borehole retention assembly shown in FIG. 16 and described in U.S. provisional application Ser. No. 60/201,193, filed May 2, 2000 and entitled Traction Module, hereby incorporated herein by reference.

Referring now to FIGS. 17–18, there is shown a further preferred embodiment of a retention assembly 410. The retention assembly 410 is shown in the contracted position in FIG. 17 and in the expanded and engaged position in FIG. 18. As best shown in FIG. 18, retention assembly 410 is shown in gripping engagement at 412 with borehole wall 84. It should be appreciated that retention assembly 410 is not shown to scale in FIGS. 17–18 and has been enlarged, as compared to borehole 86 and housing 62 of propulsion system 50, for clarity. Further, hydraulic ports 414 are shown through central tubular member 64 of housing 62 for communicating the drilling fluid pressure in flowbore 66 with a chamber 416 around housing 62. However, it should be appreciated that ports 414 are shown schematically and in fact represent a valving mechanism in propulsion system 50 such as that disclosed in U.S. Pat. No. 6,003,606, hereby incorporated herein by reference.

Retention assembly 410 includes an inner expandable member 418, a cover member 420, and a plurality of flow tubes 422. Flow tubes 422 have a kidney shaped cross-section formed by an inner arcuate side 424 and an outer arcuate side 426 with inner arcuate side 424 forming a larger arc and outer arcuate side 426 having a smaller arc whereby inner arcuate side 424 better conforms to the outer surface of housing 62 and outer arcuate surface 426 better conforms with the inside diameter of borehole wall 84. Flow tubes 422 are preferably thin walled metal tubes made of steel and may be produced from a round tube which is placed in a die and shaped to conform to the preferred cross-section. Flow tubes 42 preferably have tapered ends.

Cover member 420 is preferably made of a fabric material which does not stretch. One preferred material is reinforced NEOPRENE® or a KEVLAR® fabric with NEOPRENE® coating. A material similar to that used for the packerfeet described in U.S. Pat. No. 6,003,606 may also be used. The cover member 420 is bonded around each of the flow tubes 422 so as to over wrap each of the flow tubes 422 leaving the ends open for the passage of fluids through each of the flow paths 430 in flow tubes 422. As best shown in FIG. 18, cover member 420 is sized to have a diameter slightly greater than the diameter of borehole 86 being drilled. Some over size is required so that retention assembly 410 will engage the earth bore wall 84 where wash outs have occurred thus causing borehole 86 to be enlarged and uneven. If a slightly reduced diameter borehole is encountered, spaces 432 may occur between cover member 420 and borehole 86 where cover member 420 is not fully expanded. It is preferred that cover member 420 fully and completely engage the borehole wall around its circumference to maximize the gripping engagement between retention assembly 410 and borehole 86. As shown in FIG. 17, the cover member 420 tends to form folds 434 between adjacent flow tubes 422 in the contracted position.

The tapered ends conform to the cover member 420 in the expanded position. The fabric encompasses flow tubes 422 causing the tubes 422 to be embedded in the fabric material. There may be multiple layers of fabric material around the flow tubes 422. It is preferred that fabric material of member 420 be molded to flow tubes 422 and around the openings of flow tubes 420.

The inner expandable member 418 is preferably a balloon or bladder which is made of a material that does not stretch. Inner expandable member 418 may be made of a reinforced or non-reinforced Nitrile rubber and also may be made of a reinforced fabric that does not stretch. The expandable member 418 thus may only expand to its manufactured outer diameter. It should be appreciated that inner expandable member 418 is a separate and independent member from that of cover member 420 whereby the two members are decoupled. The inner expandable member 418 serves only as a sealing element for chamber 416. As shown in FIG. 18, inner expandable member 418 expands upon the pressurization of chamber 416 to force cover member 420 into its expanded state. As shown in FIG. 17, in the contracted position, inner expandable member 418 folds together into a plurality of folds 436.

Referring now to FIG. 17, retention assembly 410 is mounted on housing 62 of propulsion system 50. At one end, the adjacent ends of expandable member 418 and cover member 420 are fixed to housing 62 such as by a metal ring. Seals are provided between expandable member 418, cover member 420, and housing 62. The other end of retention assembly 410 is mounted on a floating or sliding ring disposed around housing 62. The ends of expandable member 418 and cover member 420 are sealed with the ring by seals. The floating ring allows the end to float or slide along housing 62 as retention assembly 410 expands and contracts. The seals may be O-ring seals.

In operation, inner expandable member 418 is inflated using the valving assembly 414 in housing 62 of propulsion system 50 by the drilling fluids flowing through flowbore 66. The flowbore pressure increases the fluid pressure within chamber 416 formed within expandable member 418. This increase in fluid pressure causes expandable member 418 to expand thus expanding cover member 420. Cover member 420 expands towards its full diameter and into gripping engagement with the borehole wall 84. The expansion of cover member 420 into engagement with borehole wall 84 provides a full, 360° bearing surface therebetween causing retention assembly 410 to fully frictionally engage borehole wall 84. It should be appreciated that while borehole wall 784is shown to be circular in FIGS. 17 and 18, in fact, borehole wall 84 is uneven and may include wash out areas forming an irregular cross-section. Cover member 420 expands to its diameter in conformance with the shape of earth bore wall 84. As shown in FIG. 18, cover member 420 in its expanded position may or may not fully engage the earth bore wall 84 at all locations leaving certain inner spatial areas 432 such as between adjacent flow tubes 422. Spatial areas 432 will be at a minimum since the fabric of the cover member 420 will be tight around its outer circumference.

The circumference and length of cover member 420 is fixed. Thus, as it expands, folds 436 are removed. However, because cover member 420 is a fabric made of KEVLAR®, or other heavy fabric reinforced rubber, cover member 420 does not stretch. When cover member 420 reaches its maximum diameter, no further expansion occurs. Upon cover member 422 reaching its maximum diameter, the interior of cover member 420 then restrains the further expansion of inner expandable member 418. Thus, expandable member 418 is not expanded fully due to flowbore pressure through flowbore 66 and is not subjected to any differential pressure between flowbore 66 and annulus 83 because expandable member 418 only occupies that area between housing 66 and the inside of cover member 420. Outer cover member 420 is subjected to the inner flowbore pressure and the frictional engagement with borehole wall 86 and thus is subjected to the tension, compression, and torque imparted by the operation of propulsion system 50. Therefore, there is no cyclic stretch and relaxation of either expandable member 418 or cover member 420. Inner expandable member 418 must only hold and contain fluid pressure. Cover member 420 may only be expanded to its pre-manufactured maximum diameter and does not stretch so as to engage the borehole wall as in the prior art. The prior art packer feet must not only stretch to engage the borehole but the stretched material must also absorb and withstand the imparted high loads of the propulsion tool while in the stretched condition.

Since the cover member 420 need not stretch to engage the wellbore 86, there is no cyclic loading of cover member 420 and the expansion forces on inner expandable member 418 are decoupled from the frictional engagement of the cover member 420 with borehole wall 86. The heavily reinforced, non-stretchable fabric of the cover member 420 takes all of the axial loads and torque from propulsion system 50. Since cover member 420 is not an expandable and stretchable material, it is not stressed while at the same time taking the loads imparted by the propulsion system 50. Such stresses are avoided because inner expandable member 418 is decoupled and independent of outer cover member 420.

As shown in FIG. 17, flow tubes 422 remain open whether in the contracted or expanded position. Therefore, flow tubes 422 maintain a constant cross-section and thus a minimum flow area around propulsion system 50 and through the annulus 83 while the retention assembly 410 is in engagement with the wall 84 of wellbore 86. Thus, flow tubes 422 serve as part of the return flow path for the fluids flowing through annulus 83. Since flow tubes 422 are metal, they do not expand or contract with the expansion and contraction of retention assembly 410. Thus, the flow paths 430 through retention assembly 410 are set whether in engagement or non-engagement with the wall 84 of wellbore 86.

The floating end allows retention assembly 410 to elevate outwardly to achieve its maximum diameter. Thus, the floating end allows retention assembly 410 to move from its contracted position with a minimum diameter shown in FIG. 17 to its expanded position with a maximum diameter shown in FIG. 18.

Other propulsion systems may also be adapted for use with the anchors of the present invention. Other types of tractors include an inchworm by Camco International, Inc., U.S. Pat. No. 5,394,951, incorporated herein by reference and by Honda, U.S. Pat. No. 5,662,020, incorporated herein by reference. Also robotic tractors are produced by Martin Marietta Energy Systems, Inc. and are disclosed in U.S. Pat. Nos. 5,497,707 and 5,601,025, each incorporated herein by reference. Another company manufactures a tractor which it calls a "Helix". See also "Inchworm Mobility—Stable, Reliable and Inexpensive," by Alexander Ferworn and Deborah Stacey; "Oil Well Tractor" by CSIRO-UTS of Australia; "Well Tractor for Use in Deviated and Horizontal Wells" by Fredrik Schussler; "Extending the Reach of Coiled Tubing Drilling (Thrusters, Equalizers, and Tractors)" by L. J. Leising, E. C. Onyia, S. C. Townsend, P. R. Paslay and D. A. Stein, SPE Paper 37656, 1997, all incorporated herein by reference. See also "Well Tractors for Highly Deviated and Horizontal Wells", SPE Paper 28871 presented at the 1994 SPE European Petroleum Conference, London Oct. 25–27, 1994, incorporated herein by reference.

It should further be appreciated that the borehole retention assemblies may be used on tractors or thrusters on a bottom hole assembly to perform other operations in a well. Such well tools include a well intervention tool, a well stimulation tool, a logging tool, a density engineering tool, a perforating tool, or a mill. The borehole retention assemblies may be used with a propulsion system for transporting well tools in and out of the borehole.

While a preferred embodiment of the invention has been shown and described, modifications thereof can be made by one skilled in the art without departing from the spirit of the invention.

What is claimed is:

1. An apparatus for retaining a well tool within a borehole having a borehole wall, comprising:

a camming member;

first and second tapered members axially spaced alone the longitudinal axis of said camming member with said camming member disposed axially between said first and second tapered members;

said first and second tapered members having a contracted position on said camming member not engaging the borehole wall and an expanded position engaging the borehole wall.

2. The apparatus of claim 1 further including an actuation assembly moving said tapered members between said expanded and contracted positions.

3. The apparatus of claim 2 wherein said actuation assembly includes a piston and cylinder.

4. The apparatus of claim 3 wherein said actuation assembly includes a return spring biasing said piston.

5. The apparatus of claim 2 wherein said tapered members, camming member and actuation member are disposed on a common mandrel.

6. The apparatus of claim 1 wherein said tapered members are disposed on a common mandrel with said tapered members extending over 180° around said mandrel.

7. The apparatus of claim 6 wherein said tapered members include tapered surfaces, a portion of which extends on each aide of said mandrel.

8. The apparatus of claim 5 wherein said tapered members and camming member have inter-engaging surfaces with said mandrel to prevent relative rotation with respect to said mandrel.

9. The apparatus of claim 1 further including biasing members forcing said tapered members and said camming member apart.

10. An apparatus for anchoring a well tool within a borehole, comprising:

a housing;

at least one inner wedge attached to said housing;

at least one extendable arm;

an outer wedge attached to said extendable arm;

a hydraulically actuated piston located within said housing;

a double sided wedge connected to said piston to engage said inner and said outer wedge concurrently; and said extendable arm actuated by engagement of said inner and said outer wedges by said double sided wedge.

11. An apparatus for anchoring a well tool within a borehole, comprising:

an extendable member; and a double sided wedge device to actuate said extendable member, said double sided wedge device comprising first and second tapered surfaces on opposite sides axially spaced along the longitudinal axis of said double sided wedge device.

* * * * *